US005831508A

United States Patent [19]

Ikeda

[11] Patent Number: 5,831,508

[45] Date of Patent: Nov. 3, 1998

[54] COMPONENT FOR A DEMAGNETIZATION CIRCUIT

[75] Inventor: Yutaka Ikeda, Shiga, Japan

[73] Assignee: Murata Manufacturing Co., Ltd., Kyoto, Japan

[21] Appl. No.: 953,325

[22] Filed: Oct. 17, 1997

[30] Foreign Application Priority Data

Dec. 9, 1996 [JP] Japan ..... 8-328072

[51] Int. Cl.[6] ..... H01H 37/14

[52] U.S. Cl. ..... 337/35; 337/3; 337/333; 337/377; 337/102; 361/150

[58] Field of Search ..... 337/3, 14, 35, 337/85, 86, 102, 298, 333, 377; 361/150

[56] References Cited

U.S. PATENT DOCUMENTS 3,495,136 2/1970 Gerritsen et al. ..... 361/150
4,024,427 5/1977 Belhomme ..... 361/150 X
4,504,817 3/1985 Shikama et al. ..... 338/23
5,241,448 8/1993 Stolte ..... 361/150
5,715,130 2/1998 Ikeda ..... 361/149

*Primary Examiner*—Leo P. Picard
*Assistant Examiner*—Jayprakash N. Gandhi
*Attorney, Agent, or Firm*—Majestic, Parsons, Siebert & Hsue P.C.

[57] ABSTRACT

A component for a demagnetization circuit includes a thermistor with positive temperature characteristic having a first electrode and a second electrode, another thermistor with negative temperature characteristic having a third electrode and a fourth electrode and being disposed such that the first and third electrodes are opposite to each other, a heat-sensitive switch disposed between these two thermistors, a case which contains the thermistors and a heat-sensitive switch, and terminals which extend outward from inside the case.

8 Claims, 5 Drawing Sheets

COMPONENT FOR A DEMAGNETIZATION CIRCUIT

BACKGROUND OF THE INVENTION

This invention relates to a component for automatic demagnetization of a cathode ray tube such as for a color TV receiver or a display monitor.

Two representative examples of such a demagnetization circuit are shown in FIGS. 10 and 11. In both FIGS. 10 and 11, numeral 1 indicates a power source circuit connected to a commercial AC source 2 which is rectified by a diode bridge 3 and the DC current smoothed by a smoothing capacitor 4 is supplied to a main circuit 5. The power source circuit 1 also comprises a power source switch 6 and a resistor 7 for suppressing the rush current from the capacitor 4. The demagnetization circuits 8 and 9 shown respectively in FIGS. 10 and 11 are each adapted to carry out demagnetization by using a current supplied from the power source circuit 1.

The demagnetization circuit 8 shown in FIG. 10 is characterized as having a demagnetization coil 10 connected in series with a thermistor 11 with positive temperature characteristic (hereinafter abbreviated as "PTC thermistor") for controlling the demagnetization current and another PTC thermistor 12 serving as a heater connected in parallel with this series connection such that these two PTC thermistors are thermally coupled. With the circuit 8 thus structured, the current-controlling thermistor 11 is heated by the heater thermistor 12 such that the resistance of the current-controlling thermistor 11 is increased and the residual demagnetization current which will flow through the demagnetization coil 10 in the steady state after demagnetization has been accomplished will be diminished. In this demagnetization circuit 8, however, the resistance of the current-controlling thermistor 11 does not increase infinitely after demagnetization. Moreover, since the current-controlling thermistor 11 has its own static capacity and serves as a capacitor, its impedance cannot be increased under the steady state condition beyond a certain limit. As a result, a residual current will flow through the demagnetization coil 10, generating an unwanted magnetic field to distort the image or causing image disturbances when a current is introduced into the demagnetization circuit 8 due to noise. Since a currents keeps flowing after demagnetization through both thermistors 11 and 12, furthermore, there is a waste of power, say, on the order of about 2 W.

These problems of the demagnetization circuit 9 can be overcome by the improved demagnetization circuit 9 of FIG. 11. Although this demagnetization circuit 9, too, has a demagnetization coil 10 connected in series with a current-controlling PTC thermistor 11, there is additionally an electromagnetic relay 13 connected in series, and this demagnetization circuit 9 is controlled such that a control signal 15, which reaches a high level for a specified length of time set by a timer circuit (not shown), will be applied to this electromagnetic relay 13 through a relay control circuit 14 such that the contact points of the relay 13 will close when demagnetization is desired and will open after the demagnetization has been completed.

With the demagnetization circuit 9 thus structured, a high impedance is obtained at the time of its shutoff because the shutoff of the circuit 9 is effected by means of mechanical contact points of the relay 13 and hence the unwanted effects of residual current and noise current on the image can be prevented. Since the current to the PTC thermistor 11 is shut off, furthermore, there is no waste of power.

For all such advantages, however, the demagnetization circuit 9 requires the electromagnetic relay 13, its control circuit 14 and a signal source for the control signal 15. Thus, its circuit structure is complicated with an increased number of components. As a result, the area of the substrate occupied by components becomes relatively large and the cost becomes higher.

Moreover, although the electromagnetic relay 13 functions to shut off the demagnetization circuit 9 always after a specified length of time has elapsed, independent of the ambient temperature or the condition of the thermistor 11, there are situations, when the ambient temperature and the temperature of the thermistor 11 are low, where the temperature of the thermistor 11 rises slowly and the attenuation of the demagnetization current is also slow. In such a situation, the demagnetization circuit 9 may be shut off before the demagnetization current becomes sufficiently weak. If this happens, not only may the effect of demagnetization be insufficient but the shadow masks may become magnetized, causing unevenness in coloring.

Japanese Patent Publication Tokkai 57-26982 disclosed an automatic demagnetizer structured similarly to the demagnetization circuit 9 shown in FIG. 11, using a heat-sensitive switch as an example of mechanical means with contact points to shut off a demagnetization circuit and using a heat-generating resistor for suppressing rush current from the power source as the heating means for activating the heat-sensitive switch. With this technology, however, the heat-sensitive switch is activated by the heat from a heat-generating component independent of the demagnetization circuit and hence independently of the intensity of the demagnetization current. Depending on the ambient temperature, therefore, the demagnetization circuit may be shut off before the demagnetization current is sufficiently attenuated or may fail to be shut off even after the appearance of an image, causing instability in the image. Moreover, the heat-generating resistor according to this technology is a part of the power source circuit and there is hardly any freedom in its resistance value, making it difficult to control the time to shut off the heat-sensitive switch appropriately. Furthermore, the shutoff time fluctuates significantly, depending on the source voltage and the power consumption (load current) of the color TV receiver or the display monitor.

SUMMARY OF THE INVENTION

It is therefore an object of this invention to provide a component for an improved demagnetization circuit with which the problems of prior art technology as described above can be overcome.

Another object of this invention is to provide such an improved component which can be assembled easily.

A component for an improved demagnetization circuit embodying this invention, with which the above and other objects can be accomplished, may be briefly characterized as comprising a PTC thermistor having electrodes (referred to as the first electrode and the second electrode), another thermistor with negative temperature characteristic (referred to as an NTC thermistor) having electrodes (referred to as the third electrode and the fourth electrode) and being disposed at a specified distance from the PTC thermistor such that the first and third electrodes are opposite to each other, a heat-sensitive switch disposed between the PTC thermistor and the NTC thermistor, a case which contains the PTC thermistor, the NTC thermistor and the heat-sensitive switch therein, and terminals (that is, a first terminal, a second terminal and a third terminal) which extend outward from inside the case.

Explained more in detail, the first terminal is electrically connected to the third electrode, the second terminal is electrically connected to the second electrode, and the third terminal is electrically connected to the fourth electrode. The heat-sensitive switch comprises a fixed contact point electrically connected to the first electrode (or the third electrode), an elastic member, a mobile contact point supported by this elastic member and electrically connected to the third electrode (or the first electrode), the elastic member being deformed by heat such that the mobile contact point contacts the fixed contact point at normal temperatures but is separated from the fixed contact point at temperatures higher than a specified threshold temperature, a first end plate and a second end plate which are disposed with a specified interval therebetween for containing therein the fixed contact point, the elastic member and the mobile contact point, and a spacer secured to the first and second end plates and serving to maintain the interval between the first and second end plates.

The component embodying this invention, as described above, is used for forming a demagnetization circuit to be used in combination with a power source circuit having a power source switch and an NTC thermistor for suppressing a rush current, comprising a demagnetization coil and a PTC thermistor for controlling the demagnetization current, carrying out a demagnetization process by providing a source current through the power source switch to the demagnetization coil. The PTC thermistor, the NTC thermistor and the heat-sensitive switch of a component embodying this invention may serve as those of such a demagnetization circuit.

As explained above, the PTC thermistor and the heat-sensitive switch is connected in series when the fixed contact point or the mobile contact point is connected electrically to the first electrode, and the heat-sensitive switch, being disposed between the PTC and NTC thermistors, is thermally coupled to both of them. The first terminal connected to the third electrode and the third terminal connected to the third electrode are connected to the power source line and the second terminal connected to the second electrode is connected to the demagnetization coil such that the demagnetization coil is connected in series to both the PTC thermistor and the heat-sensitive switch. With the component thus connected, the heat from the PTC thermistor, after the power switch is closed, causes the heat-sensitive switch to open and this open condition of the heat-sensitive switch is maintained by the heat from the NTC thermistor.

BRIEF DESCRIPTION OF THE DRAWINGS

The accompanying drawings, which are incorporated in and form a part of this specification, illustrate embodiments of the invention and, together with the description, serve to explain the principles of the invention. In the drawings.

In these figures, like components are sometimes indicated by the same numeral and not repetitiously described.

DETAILED DESCRIPTION OF THE INVENTION

Figure 1:
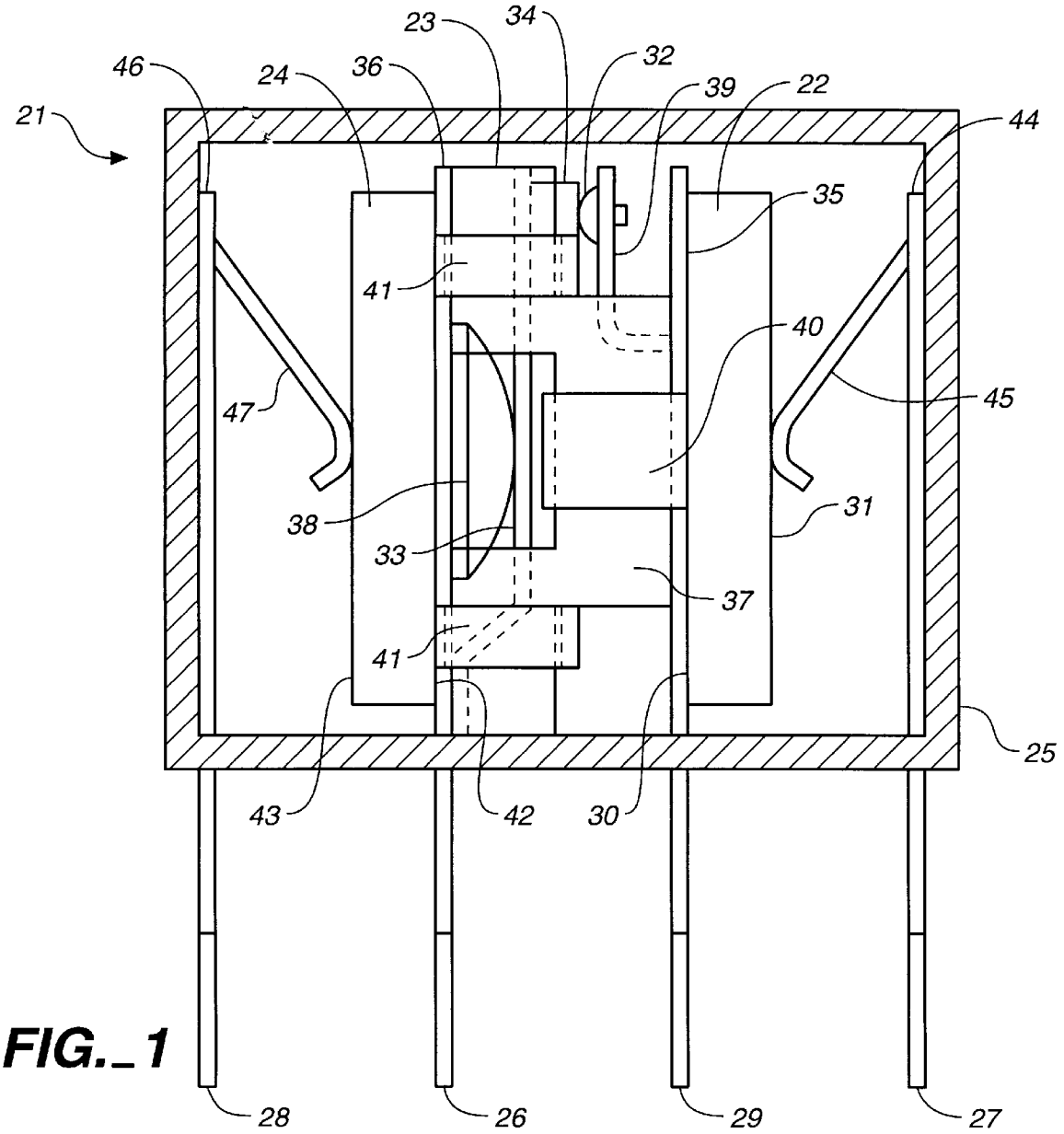
FIG. 1 is a front view of the internal structure of a component for demagnetization circuit according to one embodiment of the invention.
Figure 2:
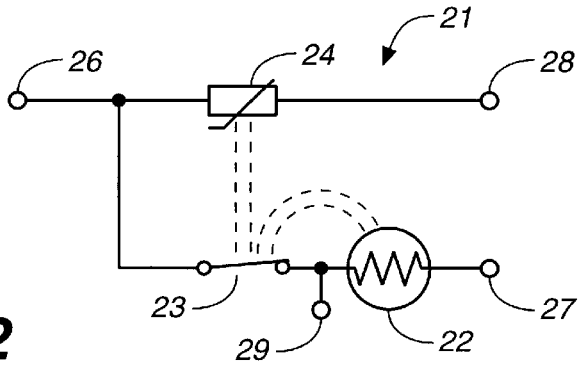
FIG. 2 is an equivalent circuit diagram of the component of FIG. 1.

FIG. 1 shows the internal structure of a component 21 for a demagnetization circuit according to one embodiment of this invention, FIG. 2 showing an equivalent circuit diagram of this component 21. As shown in FIG. 1, the component 21 according to this embodiment of the invention comprises a PTC thermistor 22, a heat-sensitive switch 23, an NTC thermistor 24, a case 25 which contains them in the order mentioned above, and first, second third and fourth terminal lead lines 26, 27, 28 and 29.

Explained more in detail, the PTC thermistor 22 has its electrodes 30 and 31 formed on its mutually opposite main surfaces. Its resistance at room temperature and Curie temperature are preferably less than 30 Ω and 50°–100° C., respectively, for providing an effective demagnetization characteristic. If its resistance at room temperature were greater than 30 Ω, a sufficiently large rush current would not be obtainable and if its Curie temperature were below 50° C., the operations of the PTC thermistor 22 would be affected strongly by the ambient temperature and it would be impossible to achieve a suitable demagnetization control. If the Curie temperature were greater than 100° C., on the other hand, attenuation of the demagnetization current would be unnecessarily delayed.

Figure 3:
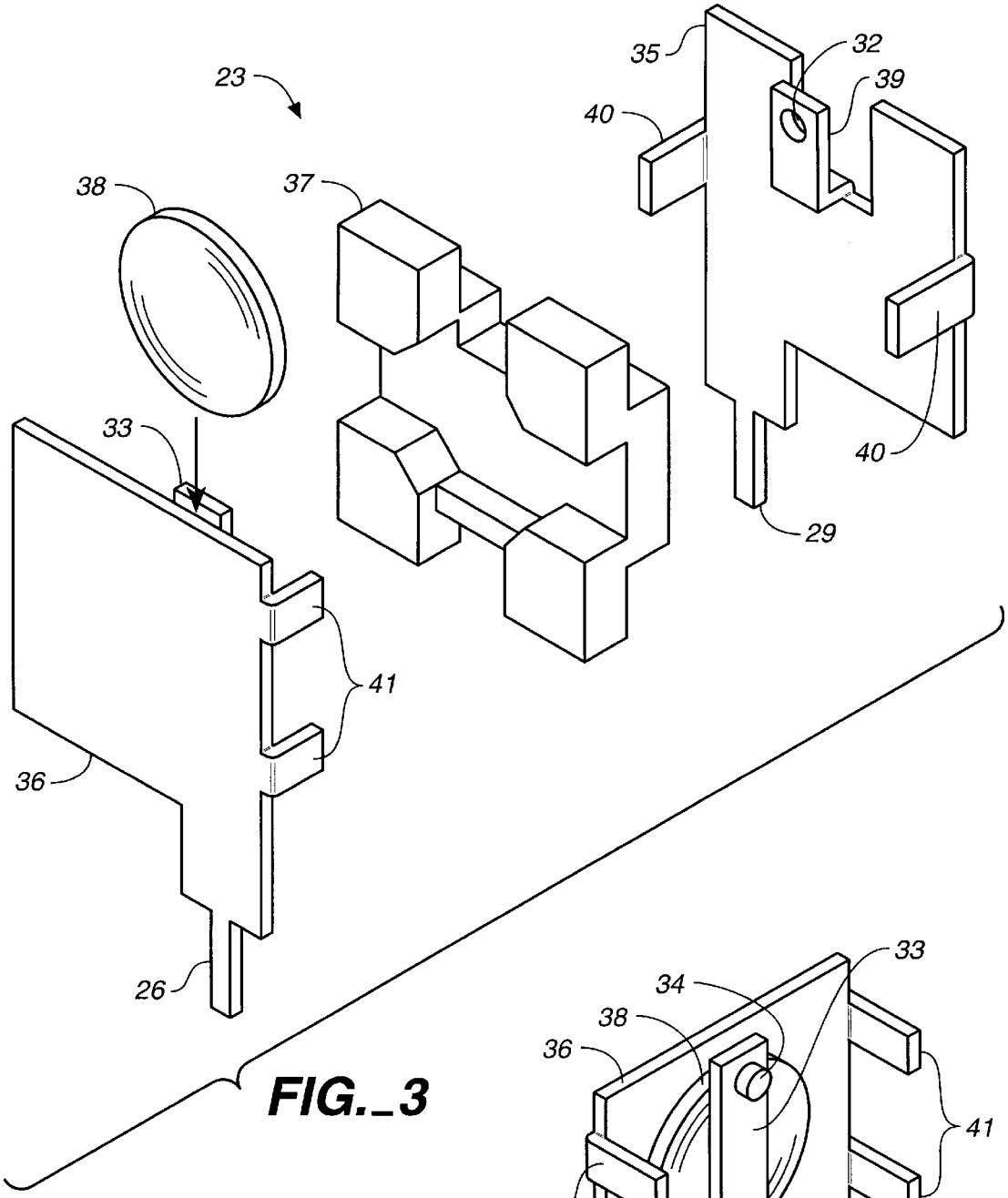
FIG. 3 is an exploded diagonal view of the heat-sensitive switch in the component shown in FIG. 1.

As shown in FIG. 3, the heat-sensitive switch 23 comprises a fixed contact point 32, an elastic deformable member 33, a mobile contact point 34, first and second end plates 35 and 36, and a spacer 37. The mobile contact point 34 is supported by the elastic member 33 so as to be in contact with the fixed contact point 32 at normal temperatures but move away from the fixed contact point 32 above a certain specified threshold temperature by the reaction of the elastic member 33 to the ambient temperature. The first and second end plates 35 and 36 are disposed away from each other so as to contain therebetween the fixed contact point 32, the elastic member 33 and the mobile contact point 34, and the spacer 37 is affixed to both the first and second end plates 35 and 36 so as to keep them apart with a specified separating distance therebetween. The two end plates 35 and 36 are made of an electrically conductive material, preferably stainless steel, phosphor bronze or Cu—Ti. The spacer 37 is preferably made of an electrically insulative material with resistance against heat. Heat-resistant resins such as polybutylene terephthalate, polyphenylene sulfide and phenol, as well as ceramic materials such as alumina may be conveniently used as material for the spacer 37.

Figure 4:
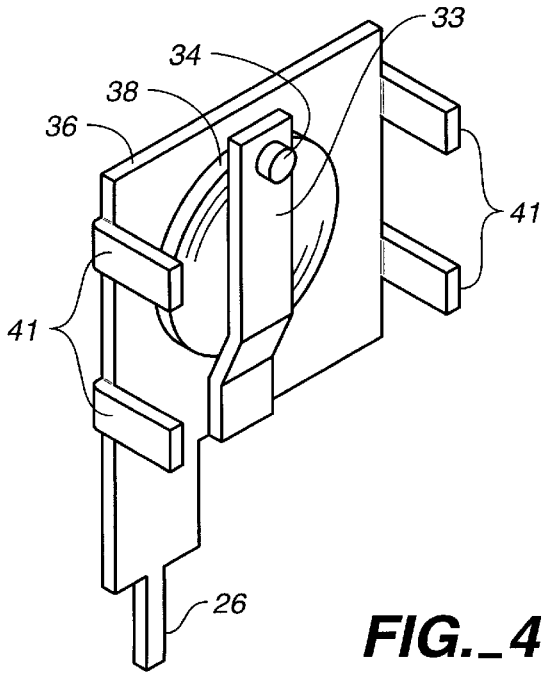
FIG. 4 is a diagonal view from a different direction of the second end plate shown in FIG. 3.

According to an embodiment of this invention, the elastic member 33 is also made of an electrically conductive material such as stainless steel, phosphor bronze or Cu—Ti and is elongated, as shown in FIG. 4, with its lower end part attached to the second end plate 36 by welding. The aforementioned mobile contact point 33 is attached to an upper end part of the elastic member 33.

In order to make the elastic member 33 react to heat as described above, a bimetallic disk 38 is inserted between the elastic member 33 and the second end plate 36, positioned by means of the spacer 37. This bimetallic disk 38 is so designed as to have an approximately spherical surface at normal temperatures but to become flat above a specified temperature. In other words, this bimetallic disk 38 serves at normal temperatures to deform the elastic member 33 so as to separate it from the second end plate 36 such that the mobile contact point 34 is in contact with the fixed contact point 32. Above the specified temperature when the bimetallic disk 38 becomes flat, however, the elastic member 33 returns to its original form by its own elasticity, moving towards the second end plate 36 and thereby causing the mobile contact point 34 to separate from the fixed contact point 32.

Explained more in detail, a bimetallic disk with operating temperature and return temperature in the range of 40°–120° C. can be preferably used for this purpose. If the operating temperature is below 40° C., it will be excessively susceptible to the ambient temperature. Since the temperature of the PTC thermistor 22 does not rise much beyond 120° C., the bimetallic disk 38 would not function even if its operating temperature were higher. The use of such a bimetallic disk, however, is not intended to limit the scope of this invention. A bimetallic member having a different shape, or a component made of an alloy with shape-memory capability may be substituted. Alternatively, the elastic member 33 itself may be made of a bimetal or a shape-retaining alloy.

As shown in FIG. 3, a portion 39 of the first end plate 35 is cut and raised, and the aforementioned fixed contact point 32 is affixed onto this raised portion 39. Thus, the position of the fixed contact point 32 can be easily varied and the pressure as well as the distance between the fixed and mobile contact points 32 and 34 can be fine-adjusted such that the chattering of the heat-sensitive switch 23 can be prevented and the useful lifetimes of the contact points 32 and 34 can be improved.

In order to fasten the two end plates 35 and 36 together with the spacer 37, the first end plate 35 has engaging pieces 40 protruding from its edges, and the second end plate 36 has similar engaging pieces 41 protruding from its edges such that these engaging pieces 40 and 41 will not get in the way of each other. After the end plates 35 and 36 and the spacer 37 in between are positioned as shown in FIG. 1, these engaging pieces 40 and 41 are folded so as to engage with parts of the spacer 37 such that the end plates 35 and 36 will remain secured to the spacer 37. The shape of the spacer 37 is selected so as not to interfere with the motion of the elastic member 33 or the contacts between the fixed and mobile contact points 32 and 34 while the two terminal plates 35 and 36 sandwich and are secured to the spacer 37.

The NTC thermistor 24 has its electrodes 42 and 43 formed on its mutually opposite main surfaces. Its resistance at room temperature and B-constant are preferably 1–100 Ω and over 2000K, respectively. If the B-constant is less than 2000K or if the resistance at room temperatures exceeds 100 Ω, the resistance value under the stead-state condition cannot be made sufficiently small. If the resistance at room temperature is less than 1 Ω, on the other hand, the rush current cannot be attenuated sufficiently.

The first end plate 35 is in contact with the inner electrode 30 of the PTC thermistor 22, and the second end plate 36 is in contact with the inner electrode 42 of the NTC thermistor 24. Not only are the first and second end plates 35 and 36 and the inner electrodes 30 and 42 electrically connected to each other, the heat-sensitive switch 23 is in a thermally coupled condition with both the PTC thermistor 22 and the NTC thermistor 24. Thus, the bimetallic disk 38 is adapted to change its surface curvature and to thereby change the position of the elastic member 33 according to a change in either the PTC thermistor 22 or the NTC thermistor 24.

The first and second end plates 35 and 36 extend to the exterior of the case 25 to thereby form the aforementioned fourth terminal lead line 29 and first terminal lead line 26, respectively. Thus, the first terminal lead line 26 connects electrically to the inner electrode 42 of the NTC thermistor 24 and the fourth terminal lead line 29 connects electrically to the inner electrode 30 of the PTC thermistor 22.

Disposed between the outer electrode 31 of the PTC thermistor 22 and an inner surface of the case 25, there is a terminal member 44 which forms a plate spring 45 serving to push the PTC thermistor 22 in the direction of the first end plate 35 and being electrically connected to its outer electrode 31. This terminal member 44 extends to the exterior of the case 25 to thereby form the aforementioned second terminal lead line 27. Thus, the second terminal lead line 27 connects electrically to the outer electrode 31 of the PTC thermistor 22. Similarly, there is another terminal member 46 disposed between the outer electrode 43 of the NTC thermistor 24 and another inner surface of the case 25. This terminal member 46 also forms a plate spring 47 serving to push the NTC thermistor 24 in the direction of the second end plate 36 and being electrically connected to its outer electrode 43. This terminal member 46 also extends to the exterior of the case 25 to thereby form the aforementioned third terminal lead line 28. Thus, the third terminal lead line 28 connects electrically to the outer electrode 43 of the NTC thermistor 24.

The case 25 is made of an electrically insulating material which is also resistant against heat. Heat-resistant resins such as phenol resin, polybutylene terephthalate and polyphenylene sulfide and ceramic materials such as alumina may be used as the material for the case 25.

The particular embodiment of the invention described above is not intended to limit the scope of the invention. For example, the fourth and first terminal lead lines 29 and 26 may be made of a different material respectively from the first and second end plates 35 and 36. Since the first and second end plates 35 and 36 are electrically non-conductive and their only function is to support the fixed contact point 32 and the elastic member 33, another conductive means may be used for the electrical connection between the fixed contact point 32, the electrode 30 of the PTC thermistor 22 and the fourth terminal lead line 29 and/or the electrical connection between the mobile contact point 34, the electrode 42 of the NTC thermistor 24 and the first terminal lead line 26. If the first and second end plates 35 and 36 are electrically non-conductive, furthermore, the spacer 37 may be of a conductive material.

As a further example, although the elastic member 33 was described above as serving to electrically connect the second end plate 36 with the mobile contact point 34, the elastic member 33 may be of a non-conductive material if another conductive means is provided to connect the first terminal lead line 26 with the mobile contact point 34. Moreover, the fixed contact point 32 may be supported on the second end plate 36, with the mobile contact point 34 and the elastic member 33 supported by the first end plate 35.

Figure 5:
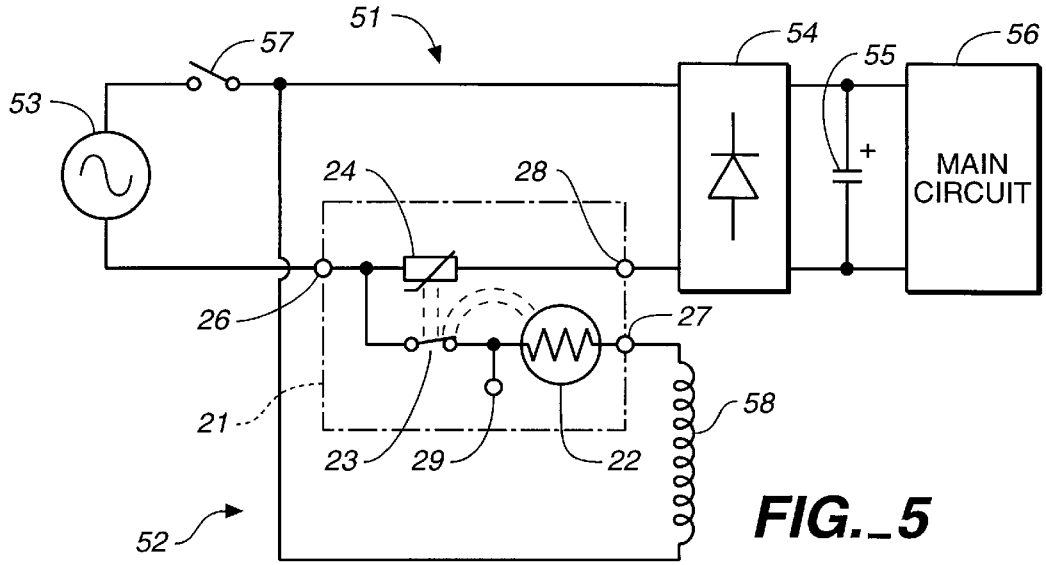
FIG. 5 is a circuit diagram showing how the component shown in FIG. 1 may be used to form a demagnetization circuit for carrying out demagnetization by using a current supplied from a power source circuit through a power switch.
Figure 10:
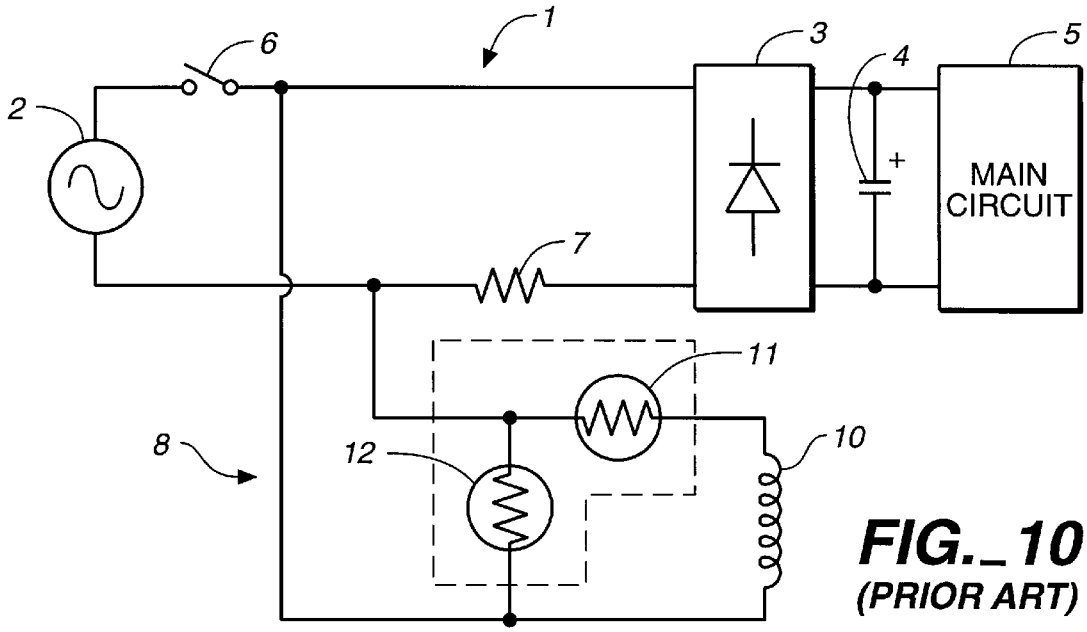
FIG. 10 (PRIOR ART)
FIG. 10 is a circuit diagram of a prior art power source circuit such as for a color TV receiver or a display monitor and a prior art demagnetization circuit.
Figure 11:
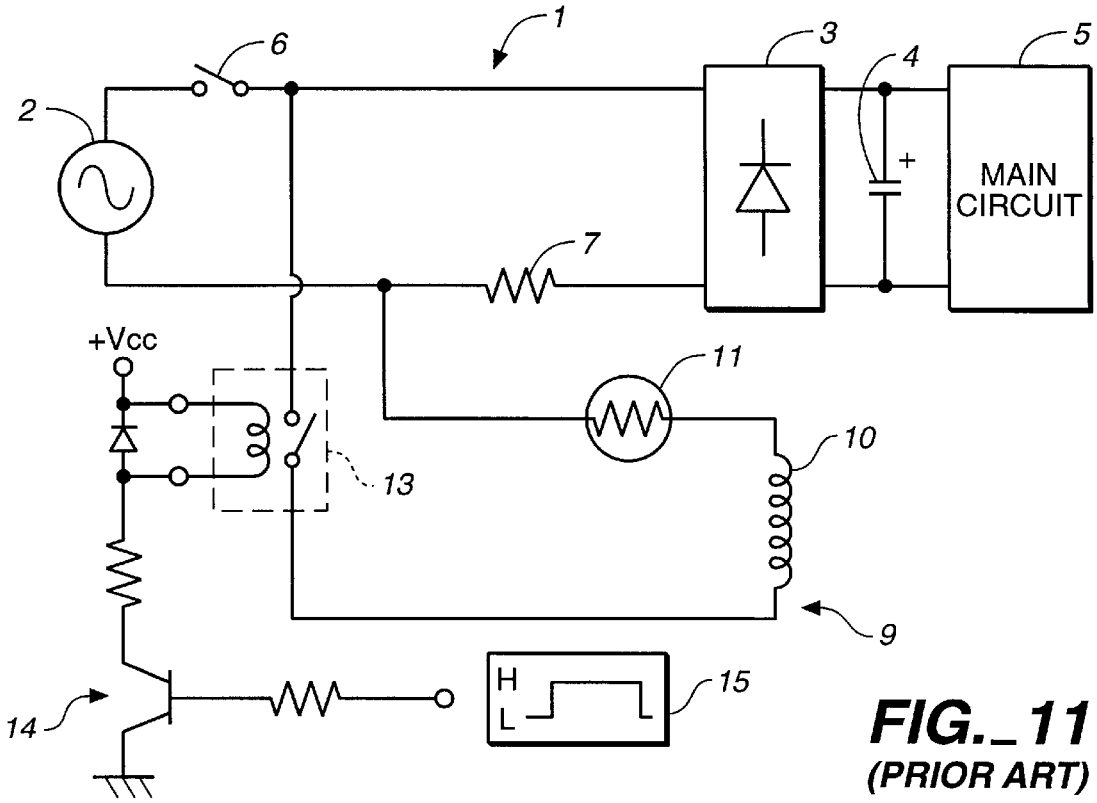
FIG. 11 (PRIOR ART)
FIG. 11 is a circuit diagram of a prior art power source circuit such as for a color TV receiver or a display monitor and another prior art demagnetization circuit.

FIG. 5 shows how the component 21, as described above and having an equivalent circuit diagram shown in FIG. 2, may be used to form a demagnetization circuit 52 by receiving a current from a power source circuit 51, say, of a color TV receiver or a display monitor. The source circuit 51 is connected to a commercial AC source 53, as shown in FIGS. 10 and 11, and a diode bridge 54 is used for rectification, the smoothed DC voltage being obtained by means of a smoothing capacitor 55 and supplied to a main circuit 56. Numeral 57 indicates a power source switch.

The terminal lead lines 26, 27 and 28 are connected as shown in FIG. 5 such that the NTC thermistor 24 can function as a resistor for suppressing the rush current from the smoothing capacitor 55 and that a demagnetization coil 58 is connected in series with the series connection of the heat-sensitive switch 23 and the PTC thermistor 22.

If the power source switch 57 in the circuit of FIG. 5 is closed, a current flows not only through the power source circuit 51 but also through the demagnetization circuit 52, causing the demagnetization process to proceed and the PTC thermistor 22 to heat up at the same time. The heat-sensitive switch 23 will open as the heat from the PTC thermistor 22 is received and a specified operating temperature is reached. This specified operating temperature is set such that the heat-sensitive switch 23 will be opened when a high enough temperature has been reached for the PTC thermistor 22 to sufficiently attenuate the demagnetization current supplied to the demagnetization coil 58. In this manner, the demagnetization circuit 52 can be shut off after the demagnetization current has reached an appropriate value.

When the demagnetization circuit 52 is shut off as described above, the PTC thermistor 22 stops generating heat but since the power source switch 57 is still closed, the current to the NTC thermistor 24 continues to flow and the NTC thermistor 24 continues to generate heat. Thus, while the power source switch 57 remains closed, the heat-sensitive switch 23 continues to receive heat from the NTC thermistor 24 and remains in the open condition.

When the power source switch 57 is opened, the NTC thermistor 24 stops generating heat and the temperature of the heat-sensitive switch 23 drops. Since the heat-sensitive switch 23 is thermally coupled with the PTC thermistor 22, however, it does not close until the temperature of the PTC thermistor 22 drops to a specified level. In other words, no current flows to the demagnetization circuit 52 again unless the temperature of the PTC thermistor 22 drops to the specified level. Thus, there will be no unwanted magnetization of the shadow mask (not shown) and no unevenness in color will appear in the image.

Moreover, since the NTC thermistor 24 serves to suppress the rush current from the power source, the power expended by the NTC thermistor 24 corresponds in the prior art power source circuits 1 of FIGS. 10 and 11 to the wasted power in the resistor 7. This means that there is no increase in the wasted power.

Still another advantage of this invention is that demagnetization can be carried out while the heat-sensitive switch 23 is open if the second and fourth terminal lead lines 27 and 29 are connected through a switch (not shown). In other words, such a switch can be closed whenever necessary to demagnetize the weak magnetization generated by the shadow mask of the color TV receiver or the display monitor which is being used. If this feature is not desired, however, the fourth terminal lead 29 may be dispensed with.

Figure 6:
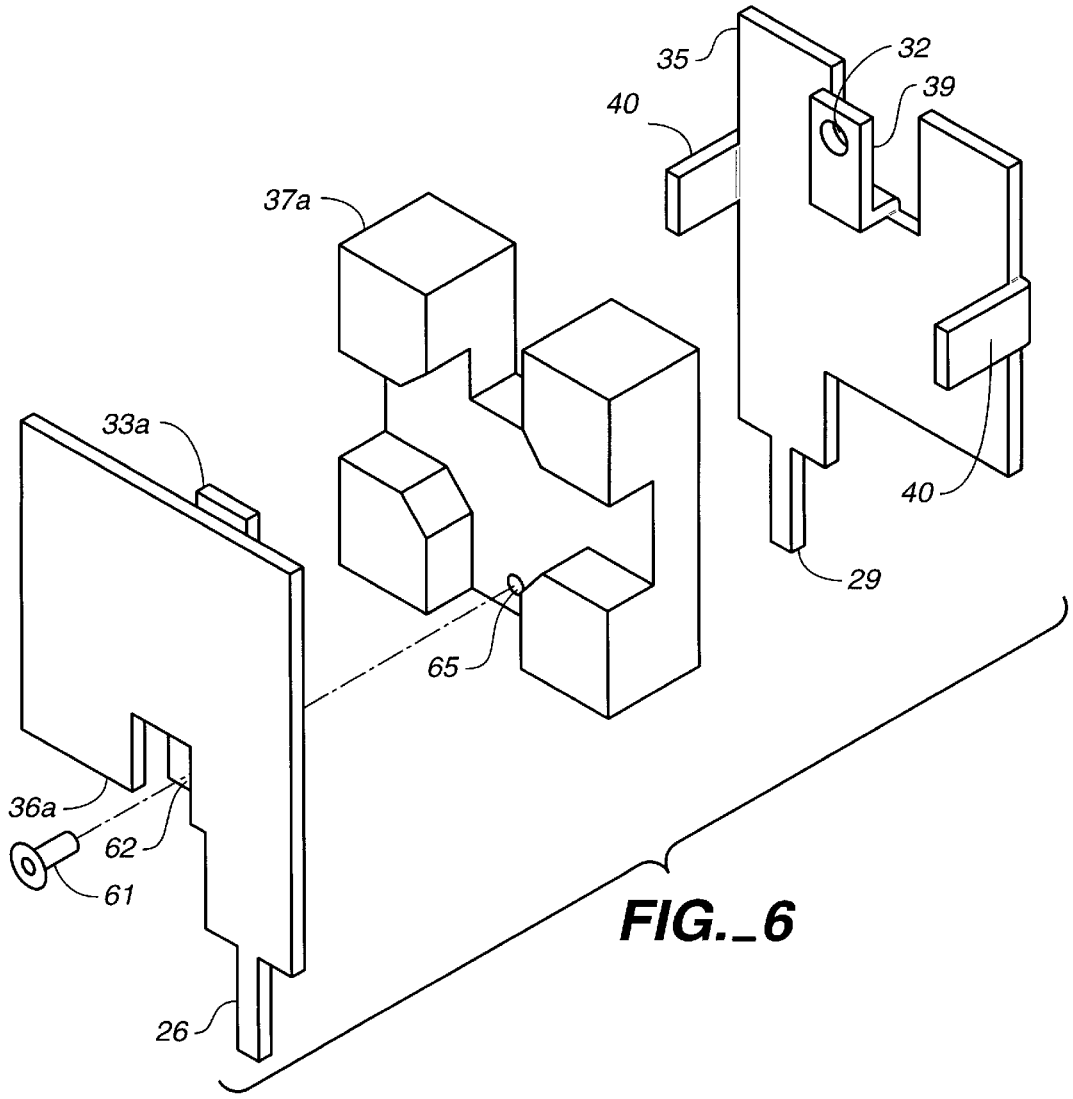
FIG. 6 is an exploded diagonal view of another heat-sensitive switch for another component embodying this invention.

FIG. 6 shows another heat-sensitive switch 23*a* which may be used in place of the switch 23 shown in FIG. 3. Since this switch 23*a* has many components which are substantially like those of the switch 23 shown in FIG. 3, like components are indicated by the same numerals as used in FIG. 3 and will not be repetitiously explained.

Figure 7:
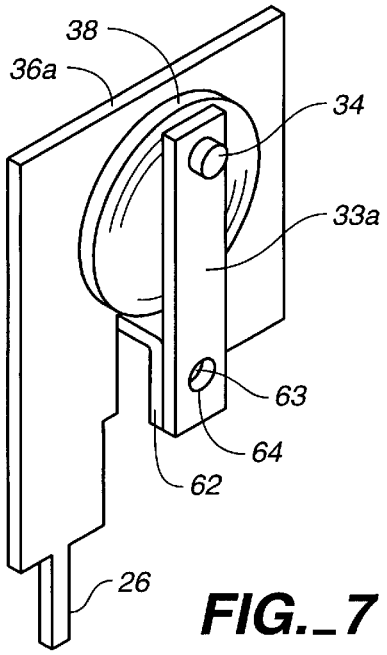
FIG. 7 is a diagonal view from a different direction of the second end plate shown in FIG. 6.
Figure 8:
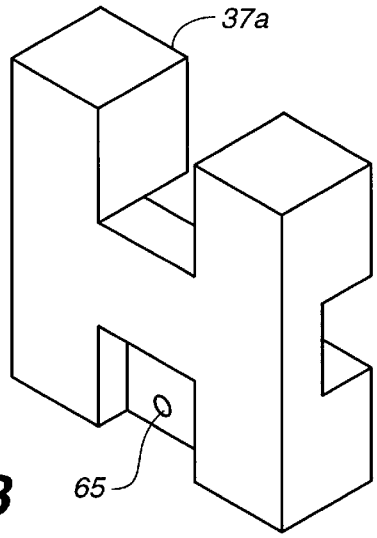
FIG. 8 is a diagonal view from a different direction of the spacer shown in FIG. 6.

The switch 23*a* of FIG. 6 is different from the switch 23 of FIG. 3 in the manner of securing the second end plate 36*a* and the spacer 37*a*, that is, they are fastened to each other by means of a rivet 61. FIGS. 7 and 8 show the second end plate 36*a* and the spacer 37*a*, respectively, as seen from different directions. As shown in FIG. 7, the second end plate 36*a* has a portion cut out and bent to form a raised part 62. A throughhole 63 for accepting the rivet 61 is formed through this raised part 62. Since the elastic member 33*a* supporting the fixed contact point 34 is also fastened by the same rivet 61 according to this embodiment, it also is provided with a throughhole 64 for the rivet 61 to pass through. As shown in FIG. 8, the spacer 37*a*, too, is provided with a throughhole 65 for the rivet 61. Thus, the second end plate 36*a* and spacer 37*a* are positioned such that their throughholes 63 and 65, as well as the throughhole 64 through the elastic member 33*a*, are aligned and then the rivet 61 is inserted therethrough and fastened such that the second end plate 36*a* and the spacer 37*a* are secured with respect to each other. The first end plate 35 is attached to the spacer 37*a* by bending the engaging pieces 40 (shown in FIG. 6) as explained above with reference to FIG. 1, but this attachment, too, may be effected by means of a rivet.

Figure 9:
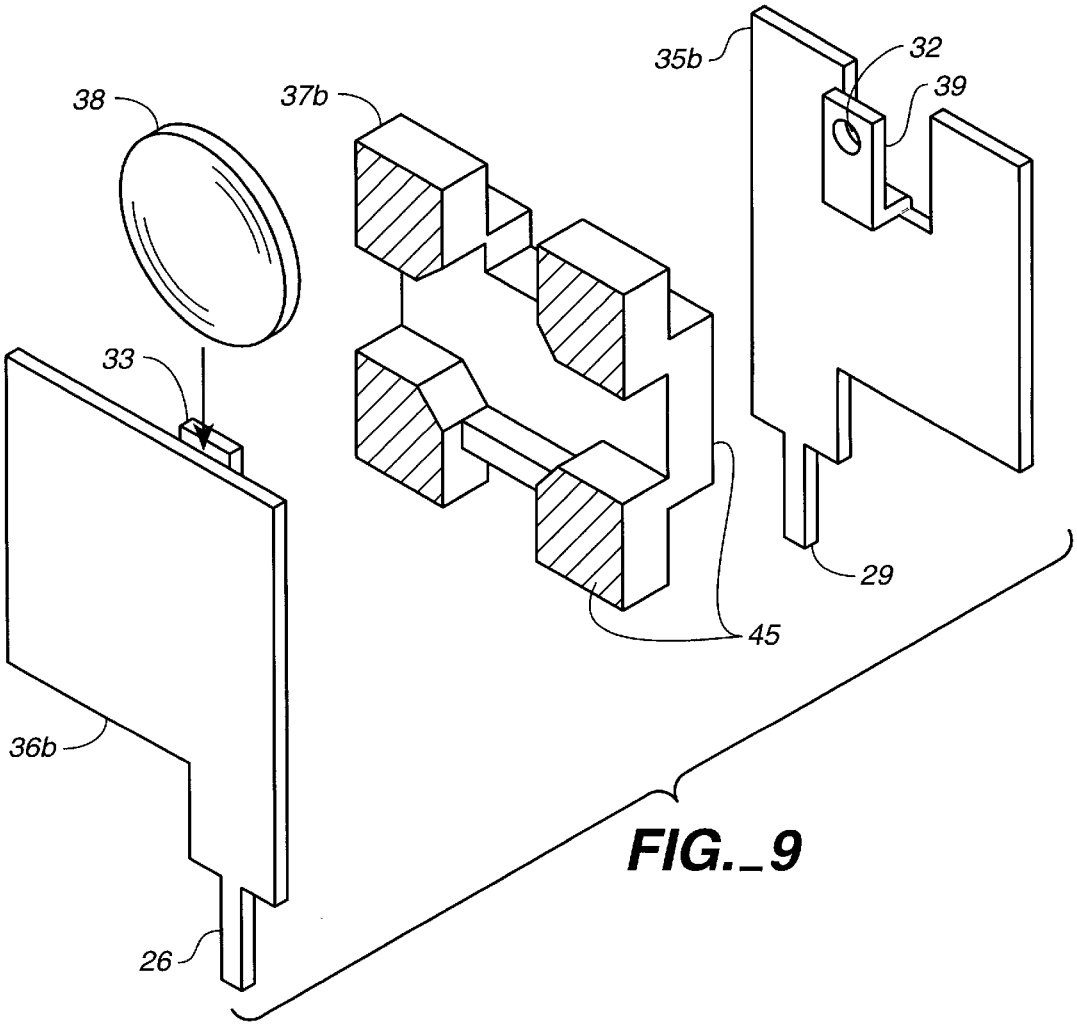
FIG. 9 is an exploded view of still another heat-sensitive switch which may be substituted.

FIG. 9 shows still another way of securing the first end plate 35*b* and the second plate 36*b* with the spacer 37*b* by means of an adhesive 45. The adhesive 45 may be used either alone, as shown in FIG. 9, or in combination with other fastening means to secure the first and second end plates 35*b* and 36*b* to the spacer 37*b*.

Although FIG. 1 showed an arrangement whereby the PTC thermistor 22 is disposed so as to contact the first end plate 35, neither is this intended to limit the scope of the invention. The PTC thermistor 22 may be disposed so as to contact the second end plate 36 and the NTC thermistor 24 so as to contact the first end plate 35. This makes the elastic member 33 to be closer to the PTC thermistor 22, and since the PTC thermistor 22 generally begins to generate heat before the NTC thermistor 24, the thermal response of the heat-sensitive switch 23 is improved.

In summary, all such modifications and variations of the embodiments described above that may be apparent to a person skilled in the art are intended to be included within the scope of the invention.

What is claimed is:

1. A component for a demagnetization circuit, said component comprising:

a PTC thermistor with positive temperature characteristic having a first electrode and a second electrode;

an NTC thermistor with negative temperature characteristic having a third electrode and a fourth electrode, said NTC thermistor being disposed at a specified distance from said PTC thermistor, said first electrode and said third electrode being opposite each other;

a heat-sensitive switch disposed between said PTC thermistor and said NTC thermistor;

a case which contains therein said PTC thermistor, said NTC thermistor and said heat-sensitive switch; and a first terminal, a second terminal and a third terminal which extend outward from inside said case, said first terminal being electrically connected to said third electrode, said second terminal being electrically connected to said second electrode, and said third terminal being electrically connected to said fourth electrode; said heat-sensitive switch comprising:

a fixed contact point electrically connected to either one of said first electrode and said third electrode;

an elastic member;

a mobile contact point supported by said elastic member and electrically connected to the other of said first electrode and said third electrode, said elastic member being deformed by heat such that said mobile contact point contacts said fixed contact point at normal temperatures and that said mobile contact point is separated from said fixed contact point at temperatures higher than a specified threshold temperature;

a first end plate and a second end plate which are disposed with an interval therebetween for containing therein said fixed contact point, said elastic member and said mobile contact point; and a spacer secured to said first end plate and said second end plate and serving to set said interval between said first end plate and said second end plate.

2. The component of claim 1 wherein said first and second end plates are electrically conductive, said spacer is electrically insulative, said first end plate is in contact with said first electrode, supports either one of said fixed contact point and said elastic member and is electrically connected to either one of said fixed contact point and said mobile contact point, and said second end plate is in contact with said third electrode, supports the other one of said fixed contact point and said elastic member and is electrically connected to the other one of said fixed contact point and said mobile contact point.

3. The component of claim 1 wherein said elastic member is electrically conductive, has one end part attached to the one of said first and second end plates that supports said elastic member, and has said mobile contact point attached to the other end part thereof.

4. The component of claim 2 wherein said first terminal is a portion of said second end plate extending out of said case.

5. The component of claim 1 wherein one of said end plates has a raised portion which is cut out and said fixed contact point is attached to said raised portion.

6. The component of claim 1 wherein said first and second end plates and said spacer are mutually secured by means of a securing mechanism which includes engagement members for engaging either of said first and second end plates with portions of said spacer.

7. The component of claim 1 wherein said first and second end plates are attached to said spacer by an adhesive.

8. The component of claim 1 wherein said first and second end plates are secured to said spacer by means of a rivet.

* * * * *